United States Patent [19]

Harandi et al.

[11] Patent Number: 4,975,179

[45] Date of Patent: Dec. 4, 1990

[54] PRODUCTION OF AROMATICS-RICH GASOLINE WITH LOW BENZENE CONTENT

[75] Inventors: Mohsen N. Harandi, Lawrenceville; Hartley Owen, Belle Mead, both of N.J.

[73] Assignee: Mobil Oil Corporation, Fairfax, Va.

[21] Appl. No.: 399,181

[22] Filed: Aug. 24, 1989

[51] Int. Cl.[5] ..... C10G 39/00

[52] U.S. Cl. ..... 208/66; 208/62; 208/135; 208/133; 585/323; 585/467

[58] Field of Search ..... 208/66; 585/323, 467

[56] References Cited

U.S. PATENT DOCUMENTS

| | | | |
|---|---|---|---|
| 2,277,938 | 3/1942 | Subkow | 208/66 |
| 2,767,124 | 10/1956 | Myers | 208/66 |
| 2,918,511 | 12/1959 | Carter et al. | 260/683.65 |
| 3,002,916 | 10/1961 | Hamilton | 208/64 |
| 3,114,696 | 12/1963 | Weisz | 208/66 |
| 3,124,523 | 3/1964 | Scott, Jr. | 208/66 |
| 3,304,340 | 2/1967 | Noll | 208/66 |
| 3,649,520 | 3/1972 | Graven | 208/93 |
| 3,770,614 | 11/1973 | Graven | 208/62 |
| 3,785,955 | 1/1974 | Davis | 208/80 |
| 3,873,439 | 3/1975 | Pollitzer | 208/66 |
| 3,899,411 | 8/1975 | Bonacci et al. | 208/66 |
| 3,928,174 | 12/1975 | Bonacci et al. | 208/66 |
| 3,928,175 | 12/1975 | Owen | 208/66 |
| 4,834,866 | 5/1989 | Schmitt | 208/66 |

*Primary Examiner*—Helane E. Myers

*Attorney, Agent, or Firm*—Alexander J. McKillop; Charles J. Speciale; Malcolm D. Keen

[57] ABSTRACT

A process is disclosed for the production of high octane gasoline rich in aromatics but containing a relatively low concentration of benzene. The process comprises the separation of $C_6$ fraction of the gasoline feedstock into n-hexane and $C_6$ isomers. The n-hexane and $C_7+$ streams are catalytically reformed to produce a reformate with a diminished yield of benzene. The reformate is separated and the $C_6-$ reformate fraction containing benzene is alkylated employing acidic metallosilicate catalyst such as ZSM-5 as the catalyst and preferably methano or propylene as the alkylating agent. The alkylate comprises $C_{7+}$ alkylaromatics. The $C_6$ isomers are blended into the gasoline pool.

14 Claims, 1 Drawing Sheet

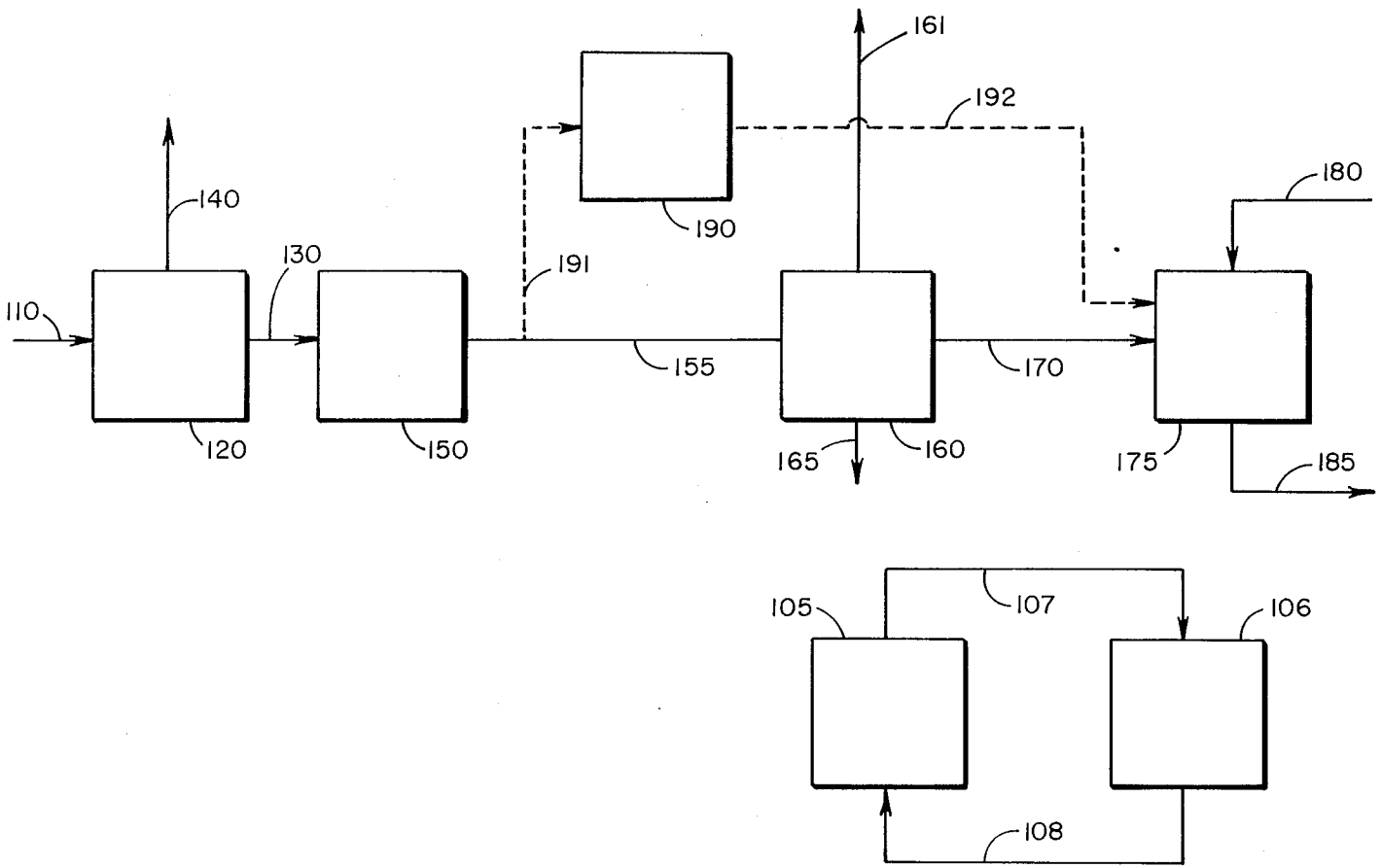
110
120
140
130
150
191
190
155
161
192
160
165
170
180
175
185
105
107
106
108

PRODUCTION OF AROMATICS-RICH GASOLINE WITH LOW BENZENE CONTENT

This invention relates to a process for catalytically reforming aliphatic hydrocarbons in the manufacture of high octane gasoline. The invention particularly relates to a process for catalytically reforming aliphatic hydrocarbons in a manner that produces less benzene while producing an aromatics-rich gasoline. More particularly, the invention relates to a process to by-pass reforming of isohexanes while reforming the n-hexane component of gasoline feedstock followed by alkylation of the reformate to produce an alkylaromatics-rich alkylate useful in the manufacture of high octane gasoline.

BACKGROUND OF THE INVENTION

In recent years, a major technical challenge presented to the petroleum refining industry has been the requirement to establish alternate processes for manufacturing high octane gasoline in view of the regulated requirement to eliminate lead additives as octane enhancers as well as the development of more efficient, higher compression ratio gasoline engines requiring higher octane fuel. To meet these requirements the industry has developed non-lead octane boosters and has reformulated high octane gasoline to incorporate an increased fraction of aromatics. While these and other approaches will fully meet the technical requirements of regulations requiring elimination of gasoline lead additives and allow the industry to meet the burgeoning market demand for high octane gasoline, the economic impact on the cost of gasoline is significant. Accordingly, workers in the field have intensified their effort to discover new processes to manufacture the gasoline products required by the market place.

Gasolines manufactured to contain a higher concentration of aromatics such as benzene, toluene and xylenes can adequately meet the octane requirements of the marketplace for a high octane fuel. Aromatics, particularly benzene, are commonly produced in refinery processes such as catalytic reforming which have been a part of the conventional refinery complex for many years. However, their substitution for the environmentally unsuitable lead octane enhancers is complicated by environmental problems of their own. Environmental and health related studies have raised serious questions regarding the human health effects of benzene. The findings suggest that exposure to high levels of benzene should be avoided with the result that benzene concentration in gasoline to enhance octane number is limited and controlled to a relatively low value. Alkylated aromatics, such as toluene and xylenes do not suffer under the same health effects liabilites as benzene and can be readily used for their octane enhancing properties.

When hydrocarbons boiling in the gasoline boiling range are reformed in the presence of a hydrogenation-dehydrogenation catalyst, a number of reactions take place which include dehydrogenation of naphthenes to form aromatics, dehydrocyclization of paraffins to form aromatics, isomerization reactions and hydrocracking reactions. It is well known that reforming conditions can be varied to favor the production of preferred products. However, when the reforming conditions are severe, coke formation in the catalyst occurs with consequent deactivation of the catalyst. Clearly, the composition of the charge to the reformer will influence the reforming conditions selected and the composition of the reformate produced. For instance, it is known that the production of benzene in the reforming process is favored when the charge contains a significant portion of benzene precursors such as hexanes. Typically, both n-hexane and isohexane are converted in the reformer, although only n-hexane has an unacceptably low octane number for consideration as part of the gasoline pool.

The treatment of a reformate with crystalline aluminosilcate zeolites is known in the art and has included both physical treatments such as selective adsorption, as well as chemical treatments such as selective conversion thereof. In U.S. Pat. No. 3,770,614 to Graven a process combination is described for upgrading naphtha boiling range hydrocarbons by a combination of catalytic reforming and selective conversion of paraffinic components to enhance yield of aromatic hydrocarbons by contact with crystalline aluminosilicate catalyst having particular conversion characteristics. In U.S. Pat. No. 3,649,520 to Graven a process is described for the production of lead free gasoline by an integrated process of reforming, aromatics recovery and isomerization including $C_6$ hydrocarbons upgrading to higher octane product for blending. The foregoing patents are incorporated herein by reference in their entirety.

It is an object of the present invention to provide a process for the manufacture of high octane lead free gasoline containing a reduced amount of benzene.

Another object of the present invention is to provide a process for the manufacture of low benzene content gasoline by avoiding reforming the high octane benzene precursors in the $C_6$ aliphatic hydrocarbon feedstream to a reformer.

Yet another object of the present invention is to provide a process for the manufacture of high octane gasoline containing alkylaromatics produced by the alkylation of benzene components in a reformate and employing acidic metallosilicate as alkylation catalyst.

SUMMARY OF THE INVENTION

It has been discovered that a high octane gasoline can be produced that is rich in octane enhancing aromatic compounds but contains a relatively low concentration of benzene. The gasoline is produced by employing a novel reforming and alkylation process that results in an increased yield of alkylaromatics and a diminished yield of benzene in the overall reformate-alkylate product. The remarkable achievement of the present invention is accomplished by bypassing the high octane iso-hexane hydrocarbon portion of the naphtha feed to the reformer zone so that reforming results in lower yields of benzene in the reformate. Further, it has been discovered that the yield of benzene in the reformate can be further reduced by subjecting the reformate to an alkylation reaction carried out in contact with an acidic metallosilicate catalyst such as an acidic aluminosilicate zeolite. The alkylation reaction produces an alkylate containing alkylated benzenes such as toluene and xylenes and a correspondingly lowered concentration of benzene.

More particularly, a fixed bed process has been discovered for the alkylation of reformate comprising $C_6$ hydrocarbons to produce high octane gasoline. The process comprises the steps of:

(a) separating the naphtha feedstream to a reformer zone into a fraction comprising iso-$C_6$ aliphatic hydrocarbon components and a reformer feedstock fraction comprising higher boiling $C_6+$ aliphatic hydrocarbon components;

(b) reforming said reformer feedstock fraction in contact with reforming catalyst and under reforming conditions to produce a reformate containing benzene and gasoline boiling range hydrocarbons;

(b) separating said reformate into a $C_6-$ hydrocarbon stream containing benzene and paraffins and a $C_7+$ hydrocarbon stream;

(c) introducing said $C_6-$ hydrocarbon stream and alkylating agent into an alkylating zone in contact with acidic metallosilicate catalyst under alkylating conditions whereby benzene is alkylated to produce high octane gasoline containing $C_7+$ aromatic hydrocarbons. In the process the $C_6$ hydrocarbon feedstock can comprise n-hexane fraction from a de-isohexanizer $C_6$ hydrocarbon feedstock splitter.

In the novel process regeneration of the catalyst for the reformer and alkylation sections can be carried out using common regeneration facilities. Also, hydrogen purge from the reformer can be used for reactivating the alkylation catalyst.

The process of the present invention is conducted in a unique reactor system that incorporates a first fractionator comprising a de-isohexanizer, a catalytic reformer reactor means receivably connected to the dehexanizer and an alkylation reactor means receivably connected to the catalytic reformer.

DESCRIPTION OF THE FIGURE

The FIGURE is a schematic illustration of the process of the present invention for the conversion of gasoline feedstock to high octane aromatics rich gasoline.

DETAILED DESCRIPTION OF THE INVENTION

The present invention discloses a fixed bed process integrated into the PtR Complex, or reformer section, of a refinery for the manufacture of high octane gasoline. The invention can improve the economics of meeting the benzene specification of the gasoline pool, preferably reducing the pool benzene content below five percent. This is achieved in a combination of steps which includes using lower alkanol such as methanol or light olefins such as propylene or light olefins containing fuel gas for alkylating benzene over a zeolite catalyst. In another step, the process optionally utilizes a fractionator upstream of the PtR Complex to separate high octane iso-hexane components from the PtR feed. Separation of iso-hexane components results in a reduced benzene yield in the reformer by limiting reforming of $C_6$ aliphatic hydrocarbons only to those of low octane number, e.g., n-hexane. The low benzene yield also advantageously effects the alkylation process by lowering the alkylation process exotherm and reducing the consumption of alkylating agent such as methanol or light olefins. The process also improves the gasoline pool Warm Up Index (WUI) which is adversely effected by alkylating benzene to $C_7+$ aromatics. The WUI is improved by blending the iso-hexane stream into the gasoline pool. Separation of the iso-hexane fraction upstream of the reformer as described in the present invention consequently results in a reduction in the required alkylation process severity for the aforestated reasons. Operating at lower severity results in a lowering of catalyst deactivation with a net increase in the process cycle length for the fixed bed zeolite alkylation reactor.

The fixed bed zeolite reactor catalyst reactivation or regeneration can be accomplished by utilizing a hydrogen $H_2$ purge stream which is typically available from the reformer unit. Advantageously, in the integrated process of the present invention, the regeneration or reactivation of spent zeolite catalyst may be incorporated with the reforming catalyst regeneration capabilities in such a way as to utilize the ancillary equipment of reformer catalyst regeneration, such as compressors and heat exchangers, to provide and treat the regenerating gas required for zeolite spent catalyst regeneration.

For purposes of this invention, the term "zeolite" is meant to include the class of porotectosilicates, i.e., porous crystalline silicates, which contain silicon and oxygen atoms as the major components Other components can be present in minor amounts, usually less than 14 mole %, and preferably less than 4 mole %. These components include aluminum, gallium, iron, boron, and the like, with aluminum being preferred. The minor components can be present separately or in mixtures in the catalyst They can also be present intrinsically in the framework structure of the catalyst. The framework silica-to-alumina mole ratio referred to can be determined by conventional analysis. This ratio is meant to represent, as closely as possible, the mole ratio of silica to alumina in the rigid anionic framework of the zeolite crystal and to exclude any alumina which may be present in a binder material optionally associated with the zeolite or present in cationic or other form within the channels of the zeolite. Although zeolites with a silica-to-alumina mole ratio of as low as about 7 are useful, it is preferred to use zeolites having much higher silica-to-alumina mole rations, i.e., ratios of at least about 12:1 and preferably greater than about 50:1, e.g., 70:1, and even higher. In addition zeolites as otherwise characterized herein but which are substantially free of aluminum, i.e., having silica-to-alumina mole ratios up to and including infinity, are useful and can even be preferable in some cases. The useful class of zeolites, after activation, acquire an intra-crystalline sorption affinity for normal hexane which is greater than that for water, i.e., they exhibit "hydrophobic" properties.

A convenient measure of the extent to which a zeolite provides controlled access to molecules of varying sizes to its internal structure is the aforementioned Constraint Index of the zeolite. A zeolite which provides relatively restricted access to, and egress from, its internal structure is characterized by a relatively high value for the Constrain Index, i.e., above about 2. On the other hand, zeolites which provide relatively free access to the internal zeolitic structure have a relatively low value for the Constraint Index, i.e., about 2 or less. The method by which Constraint Index is determined is described fully in U.S. Pat. No. 4,016,218, to which reference is made for details of the method.

Constraint Index (CI) values for some zeolites which can be used in the process of this invention are:

| Zeolite | Constraint Index (At Test Temperature, °C.) |
|---|---|
| ZSM-4 | 0.5 (316) |
| ZSM-5 | 6–8.3 (371–316) |
| ZSM-11 | 5–8.7 (371–316) |
| ZSM-12 | 2.3 (316) |
| ZSM-20 | 0.5 (371) |
| ZSM-35 | 4.5 (454) |
| ZSM-38 | 2 (510) |
| ZSM-48 | 3.5 (538) |

-continued

| Zeolite | Constraint Index (At Test Temperature, °C.) |
|---|---|
| ZSM-50 | 2.1 (427) |
| TMA Offretite | 3.7 (316) |
| TEA Mordenite | 0.4 (316) |
| Clinoptilolite | 3.4 (510) |
| Mordenite | 0.5 (316) |
| REY | 0.4 (316) |
| Amorphous Silica-Alumina | 0.6 (538) |
| Dealuminized Y | 0.5 (510) |
| Zeolite Beta | 0.6–2.0 (316–399) |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., can affect the Constraint Index. Therefore, it will be appreciated that it may be possible to so select test conditions, e.g., temperatures, as to establish more than one value for the Constraint Index of a particular zeolite. This explains the range of Constraint Indices for zeolite Beta.

Useful zeolite catalysts of the intermediate pore size variety, and possessing a Constraint Index of greater than about 2 up to about 12, include such materials as ZSM-5, ZSM-11, ZSM-23, ZSM-35, and ZSM-38.

ZSM-5 is more particularly described in Reissue U.S. Pat. No. 28,341 (of original U.S. Pat. No. 3,702,886), the entire contents of which are incorporated herein by reference.

ZSM-11 is more particularly described in U.S. Pat. No. 3,709,979, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference. Although ZSM-38 possesses a Constraint Index of 2.0, it is often classified with the intermediate pore size zeolites and will therefore be regarded as such for purposes of this invention.

The large pore zeolites which are useful as catalysts in the process of this invention, i.e., those zeolites having a Constraint Index of no greater than about 2, are well known to the art. Representative of these zeolites are zeolite Beta, zeolite X, zeolite L, zeolite Y, ultrastable zeolite Y (USY), dealuminized Y (Deal Y), rare earth-exchanged zeolite Y (REY), rare earth-exchanged dealuminized Y (RE Deal Y) mordenite, ZSM-3, ZSM-4, ZSM-12, ZSM-20, and ZSM-50 and mixtures of any of the foregoing. Although zeolite Beta has a Constraint Index of about 2 or less, it should be noted that this zeolite does not behave exactly like other large pore zeolites. However, zeolite Beta does satisfy the requirements for a catalyst of the present invention.

Zeolite Beta is described in Reissue U.S. Pat. No. 28,341 (of original U.S. Pat. No. 3,308,069), to which reference is made for details of this catalyst.

Zeolite X is described in U.S. Pat. No. 2,882,244, to which reference is made for the details of this catalyst.

Zeolite L is described in U.S. Pat. No. 3,216,789, to which reference is made for the details of this catalyst.

Zeolite Y is described in U.S. Pat. No. 3,130,007, to which reference is made for details of this catalyst.

Low solium ultrastable zeolite Y (USY) is described in U.S. Pat. Nos. 3,293,192; 3,354,077; 3,375,065; 3,402,996; 3,449,070; and 3,595,611, to which reference is made for details of this catalyst.

Dealuminized zeolite Y (Deal Y) can be prepared by the method found in U.S. Pat. No. 3,442,795, to which reference is made for details of this catalyst.

Zeolite ZSM-3 is described in U.S. Pat. No. 3,415,736, to which reference is made for details of this catalyst Zeolite ZSM-4 is described in U.S. Pat. No. 3,923,639, to which reference is made for details of this catalyst.

Zeolite ZSM-12 is described in U.S. Pat. No. 3,832,449, to which reference is made for the details of this catalyst.

Zeolite ZSM-20 is described in U.S. Pat. No. 3,972,983, to which reference is made for the details of this catalyst.

Zeolite ZSM-50 is described in U.S. Pat. No. 4,640,829, to which reference is made for details of this catalyst.

Also, included within the definition of the useful zeolites are crystalline porous silicoaluminophosphates such as those disclosed in U.S. Pat. No. 4,440,871, the catalytic behavior of which is similar to that of the aluminosilicate zeolites.

The zeolite(s) selected for use herein will generally possess an alpha value of at least about 1, preferably at least 10 and more preferably at least about 100. "Alpha value", or "alpha number", is a measure of zeolite acidic functionality and is more fully described together with details of its measurement in U.S. Pat. No. 4,016,218, *J. Catalysis*, 6, pp. 278–287 (1966) and *J. Catalysis*, 61, pp. 390–396 (1980). Zeolites of low acidity (alpha values of less than about 200) can be achieved by a variety of techniques including (a) synthesizing a zeolite with a high silica/alumina ration, (b) steaming, (c) steaming followed by dealuminization and (d) substituting framework aluminum with other species. For example, in the case of steaming, the zeolite(s) can be exposed to steam at elevated temperatures ranging from about 500° F. to about 1200° F. and preferably from about 750° to about 1000° F. This treatment can be accomplished in an atmosphere of 100% steam or an atmosphere consisting of steam and a gas which is substantially inert to the zeolite. A similar treatment can be accomplished at lower temperatures employing elevated pressure, e.g., at from about 350° to about 700° F. with from about 10 to about 200 atmospheres. Specific details of several steaming procedures may be gained from the disclosures of U.S. Pat. Nos 4,325,994; 4,374,296; and 4,418,235, the contents of which are incorporated by reference herein. Aside from, or in addition to an of the foregoing procedures, the surface acidity of the zeolite(s) can be eliminated or reduced by treatment with bulky reagents as described in U.S. Pat. No. 4,520,221, the contents of which are incorporated by reference herein.

Referring to the FIGURE, the process of the instant invention is illustrated in a schematic block diagram. A $C_6$ hydrocarbon feedstream 110 is passed to fractionator 120 for separation into n-hexane stream 130 and a $C_6$ isomer stream 140. The n-hexane stream is passed to a catalytic reformer 150 containing reforming catalyst under reaction conditions comprising up to 450 psig and between 455° C. and 538° C. The reformate stream 155 is passed to a splitter 160 for separation of $C_7+$ or $C_8+$ stream 165 and $C_6$ or $C_6$–$C_7$ stream 170, and $C_5$–$C_6$ overhead stream 161. The $C_6$ or $C_6$–$C_7$ stream containing benzene, or benzene and toluene, and paraffins is passed to alkylation reactor 175 preferably containing ZSM-5 catalyst. Alkylating agents comprising preferably methanol or light olefins are passed to the alkylation reactor via conduit 180. The alkylation conditions preferably comprise between 30 and 800 psi and temperature between 215° C. and 482° C. The alkylation reactor effluent 185 containing unconverted benzene, toluene and $C_8$–$C_{11}$ aromatics is sent to the recovery section. Typically, 30–60% of benzene is converted per pass. Part of the reactants, preferably olefins, may be used as reactor internal quench. Optionally, the reformate may be passed 191 to debutanizer 190 for separation of $C_6$ or $C_6$–$C_7$ stream 192.

Still referring to the FIGURE, there is shown catalyst regeneration sections 105 and 106. Section 105 comprises the regeneration section for the reforming unit while section 106 comprises the regeneration section for the zeolite alkylation process. These sections include fixed bed reactors which are taken off line for catalyst regeneration or are subject to regeneration when the entire process is down, following operation procedures well known to the artisan for operation of fixed bed processes. In the present invention it has been determined that the facilities of the reformer regenerator section 105, i.e., compressors, pumps, heat exchangers, instrumentation, etc., can be used in the regeneration of zeolite alkylation catalyst in section 106. Regeneration of fixed bed zeolite can be carried out by passing 107 regeneration gas from regenerator section 105 to zeolite section 106 and recycling 108 to the reformer regenerator section 105. Fixed bed zeolite can be reactivated using reformer $H_2$ product stream.

Although the present invention has been described with preferred embodiments, it is to be understood that modifications and variations may be resorted to without departing from the spirit and scope of this invention, as those skilled in the art will readily understand. Such modifications and variations are considered to be within the purvue and scope of the apended claims.

What is claimed is:

1. A fixed bed process for the alkylation of reformate comprising $C_6$– hydrocarbons to produce high octane gasoline, comprising;

(a) separating a naphtha feedstream by fractionation into a lower boiling fraction comprising iso-$C_6$ aliphatic hydrocarbon components and a reformer feedstock fraction comprising higher boiling $C_{6+}$ aliphatic hydrocarbon components;

(b) reforming the reformer feedstock fraction comprising the higher boiling $C_{6+}$ aliphatic components in contact with reforming catalyst and under reforming conditions to produce a reformate containing benzene and $C_{7+}$ hydrocarbons;

(c) separating said reformate into a $C_6$– hydrocarbon stream containing benzene and paraffins and a $C_{7+}$ hydrocarbon stream;

(d) introducing said $C_6$– hydrocarbon stream and alkylating agent into an alkylating zone in contact with acidic metallosilicate catalyst under alkylating conditions whereby benzene is alkylated to produce high octane gasoline containing $C_{7+}$ aromatic hydrocarbons.

2. The process of claim 1 wherein said $C_{6+}$ hydrocarbon feedstock comprises n-hexane fraction from a de-isohexanizer $C_6$ hydrocarbon feedstock splitter.

3. The process of claim 1 wherein said alkylating agent is taken from the group comprising light olefins, lower alkanol and fuel gas containing light olefins.

4. The process of claim 3 wherein said light olefins comprise propylene and said lower alkanol comprises methanol.

5. The process of claim 1 wherein said reformate is separated in a fractionator to produce said $C_6$– hydrocarbon stream.

6. The process of claim 1 wherein said metallosilicate catalyst comprises acidic, shape-selective aluminosilicate zeolite.

7. The process of claim 6 wherein said zeolite comprises ZSM-5.

8. A process for the conversion of $C_6$ hydrocarbons into high octane aromatics-rich gasoline containing a reduced amount of benzene, comprising;

(a) separating by fractionation a feedstock comprising $C_6$ hydrocarbons into a first, higher boiling fraction comprising n-hexane and a second, lower boiling fraction comprising iso-hexane in a de-isohexanizer fractionator;

(b) introducing said first, higher boiling n-hexane fraction to a hydrocarbons reforming zone in contact with reforming catalyst under reforming conditions whereby reformate is produced containing a reduced amount of benzene;

(c) separating said reformate into a $C_7$– hydrocarbon stream containing benzene and paraffins and a $C_{7+}$ hydrocarbon stream;

(d) introducing at least a portion of said $C_7$– hydrocarbon stream and alkylating agent into an alkylating zone in contact with acidic metallosilicate catalyst under alkylating conditions whereby benzene is alkylated to produce high octane gasoline containing $C_{7+}$ aromatic hydrocarbons.

9. The process of claim 8 wherein said alkylating agent is taken from the group comprising light olefins, lower alkanol and fuel gas containing light olefins.

10. The process of claim 9 wherein said light olefins comprise propylene and said lower alkanol comprises methanol.

11. The process of claim 8 wherein said reformate is separated in a fractionator to produce said $C_7$– hydrocarbon stream.

12. The process of claim 8 wherein said metallosilicate catalyst comprises acidic, shape-selective aluminosilicate zeolite.

13. The process of claim 12 wherein said zeolite comprises ZSM-5.

14. The process of claim 8 wherein step (a) iso-hexane fraction is combined with step (d) high octane gasoline.

* * * * *